US007748757B2

(12) United States Patent
Shen

(10) Patent No.: US 7,748,757 B2
(45) Date of Patent: Jul. 6, 2010

(54) CONNECTING DEVICE FOR CONCEALED-TYPE TOP OR BOTTOM LATCH FOR PANIC EXIT DOOR LOCK

(75) Inventor: Chun-Meng Shen, Sinying (TW)

(73) Assignee: I-Tek Metal Mfg. Co. Ltd., Tainan (TW)

( * ) Notice: Subject to any disclaimer, the term of this patent is extended or adjusted under 35 U.S.C. 154(b) by 15 days.

(21) Appl. No.: 12/211,871

(22) Filed: Sep. 17, 2008

(65) Prior Publication Data

US 2010/0066101 A1 Mar. 18, 2010

(51) Int. Cl.
*F01B 19/00* (2006.01)

(52) U.S. Cl. ..... 292/92; 292/DIG. 65; 70/92

(58) Field of Classification Search ..... 292/92, 292/21, 34, 156, DIG. 65, 93, 94; 70/92
See application file for complete search history.

(56) References Cited

U.S. PATENT DOCUMENTS 3,582,122 A * 6/1971 Foster et al. ..... 292/335
4,741,563 A * 5/1988 Cohrs ..... 292/21
4,906,034 A * 3/1990 Verslycken ..... 292/92
4,961,330 A 10/1990 Evans ..... 292/21
4,974,890 A 12/1990 Cohrs ..... 292/363.3
5,527,074 A * 6/1996 Yeh ..... 292/177
5,816,017 A * 10/1998 Hunt et al. ..... 52/784.11
6,000,733 A * 12/1999 Linder ..... 292/92
6,532,777 B2 * 3/2003 Haeck et al. ..... 70/92
6,945,571 B2 * 9/2005 Lin ..... 292/92

* cited by examiner

*Primary Examiner*—Peter M. Cuomo
*Assistant Examiner*—Mark Williams
(74) *Attorney, Agent, or Firm*—Alan Kamrath; Kamrath & Associates PA

(57) ABSTRACT

A connecting device (40) for a concealed-type latch of a lock for a panic exit door includes a connecting member (46) having an end (464) operably coupled to a latch (128). A draw rod (48) includes an end (484) pivotably coupled to the other end (462) of the connecting member (46) and pivotable between a first position parallel to the connecting member (46) and a second position perpendicular to the connecting member (46). The connecting device (40) can be installed via an end opening (104) in a top or bottom edge of a door (10) into an interior space (102) of the door (10) with the draw rod (48) in the first position. When the draw rod (48) reaches a side opening (106) of the door (10), it is pivoted to the second position for coupling with a follower device (30) of the lock.

7 Claims, 15 Drawing Sheets

CONNECTING DEVICE FOR CONCEALED-TYPE TOP OR BOTTOM LATCH FOR PANIC EXIT DOOR LOCK

BACKGROUND OF THE INVENTION

The present invention relates to a connecting device for a concealed-type latch for a panic exit door lock and, more particularly, to an adjustable connecting device for a concealed-type top or bottom latch for a panic exit door lock that allows easy mounting of the connecting device.

Locks for panic exit doors include horizontal type latches and vertical type latches. Vertical type latches include a top latch and a bottom latch, wherein the top and bottom latches include concealed type and surfaced type according to the way they are mounted. Surfaced type latches are easy to install but can not provide an aesthetically pleasing appearance. Concealed type latches provide an aesthetically pleasing appearance at the cost of difficulties in installation.

FIG. 15 shows a conventional panic exit door 70 including a side opening 702 in an inner side thereof. Door 70 further includes an end opening 704 in each of a top edge and a bottom edge thereof. A panic device or lock 80 is mounted to door 70 and includes an operative device 84, a follower device 82, and concealed type top and bottom latch devices 76 both mounted in an interior space 706 in door 70 and each having a latch 762. A hole or stop is formed on each of a top edge and a bottom edge of a door frame for coupling with latch 762 when door 70 is closed. Each latch device 76 further includes a screw rod 764 having a first end coupled to latch 762 and a second end coupled to an end of a coupling rod 74. The other end of each coupling rod 74 is coupled to a vertical section 724 of a connecting rod 72. Each connecting rod 72 includes a horizontal section 722 extending out of door 70 via side opening 702 and coupled with follower device 82. Operation of operative device 84 causes movement of follower device 82, connecting rods 72, and coupling rods 74 to move latches 76 for locking or unlocking purposes. Horizontal section 722 of each connecting rod 72 generally has a length larger than a width of door 70, such that connecting rod 72 can only be mounted via side opening 704 rather than end opening 704. Furthermore, coupling rods 74 of a certain length are required to couple connecting rods 72 to screw rods 764. In practice, connecting rods 72 and coupling rods 74 are inserted via side end opening 702 into interior space 706 of door 70 in an inclined angle for installation purposes. Coupling rods 74 are then threadedly coupled to screw rods 764. Such installation is difficult to be accomplished by a single installer.

Thus, a need exists for a connecting device for a concealed-type top or bottom latch for a panic exit door that allows easy installation of the connecting device.

BRIEF SUMMARY OF THE INVENTION

The present invention solves this need and other problems in the field of locks for panic exit doors by providing, in a preferred form, a connecting device for a concealed-type latch of a lock for a panic exit door including a connecting member having first and seconds. The second end of the connecting member is adapted to be operably coupled to a latch of the lock, so that movement of the connecting member in a vertical direction causes pivotal movement of the latch between an extended, locking position and a retracted, unlocking position. The connecting device further includes a draw rod having first and second ends. The second end of the draw rod is pivotably coupled to the first end of the connecting member and pivotable between a first position and a second position. The draw rod is parallel to the connecting member when in the first position. On the other hand, the draw rod is perpendicular to the connecting member when in the second position. The first end of the draw rod is adapted to be operably coupled to an operative member of the lock when the draw rod is in the second position, so that operation of the operative member causes movement of the connecting member in the vertical direction. The connecting device can be installed via an end opening in a top or bottom edge of a door into an interior space of the door with the draw rod in the first position. When the draw rod reaches a side opening of the door, it is pivoted to the second position for coupling with a follower device coupled to the operative member.

In the most preferred form, the first end of the connecting member includes first and second faces and a through-hole extending from the first face through the second face. A plurality of annularly spaced pegs are formed on the first face of the first end of the connecting member and surround the through-hole. The second end of the draw rod includes first and second sides and a pin hole extending from the first side through the second side and aligned with the through-hole. The second end of the draw rod further includes a plurality of annularly spaced positioning holes surrounding the pin hole. The positioning holes are engaged with the pegs when the draw rod is in the second position. A pin includes a head and a shank having a first shank portion extending from a side of the head and a second shank portion extending from an end face of the first shank portion. The first shank portion slideably extends through the through-hole of the connecting member. The second shank portion extends through the pin hole of the draw rod. A resilient plate is mounted between the side of the head and the second face of the first end of the connecting member. The pin is slideable relative to the connecting member in an axial direction of the shank between a compressing position compressing the resilient plate and a non-compressing position not compressing the resilient plate. The pin is in the non-compressing position when the draw rod is in the second position. The pegs are disengaged from the positioning holes and press against the first side of the second end of the draw rod and with the pin in the compressing position when the draw rod is in the first position.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
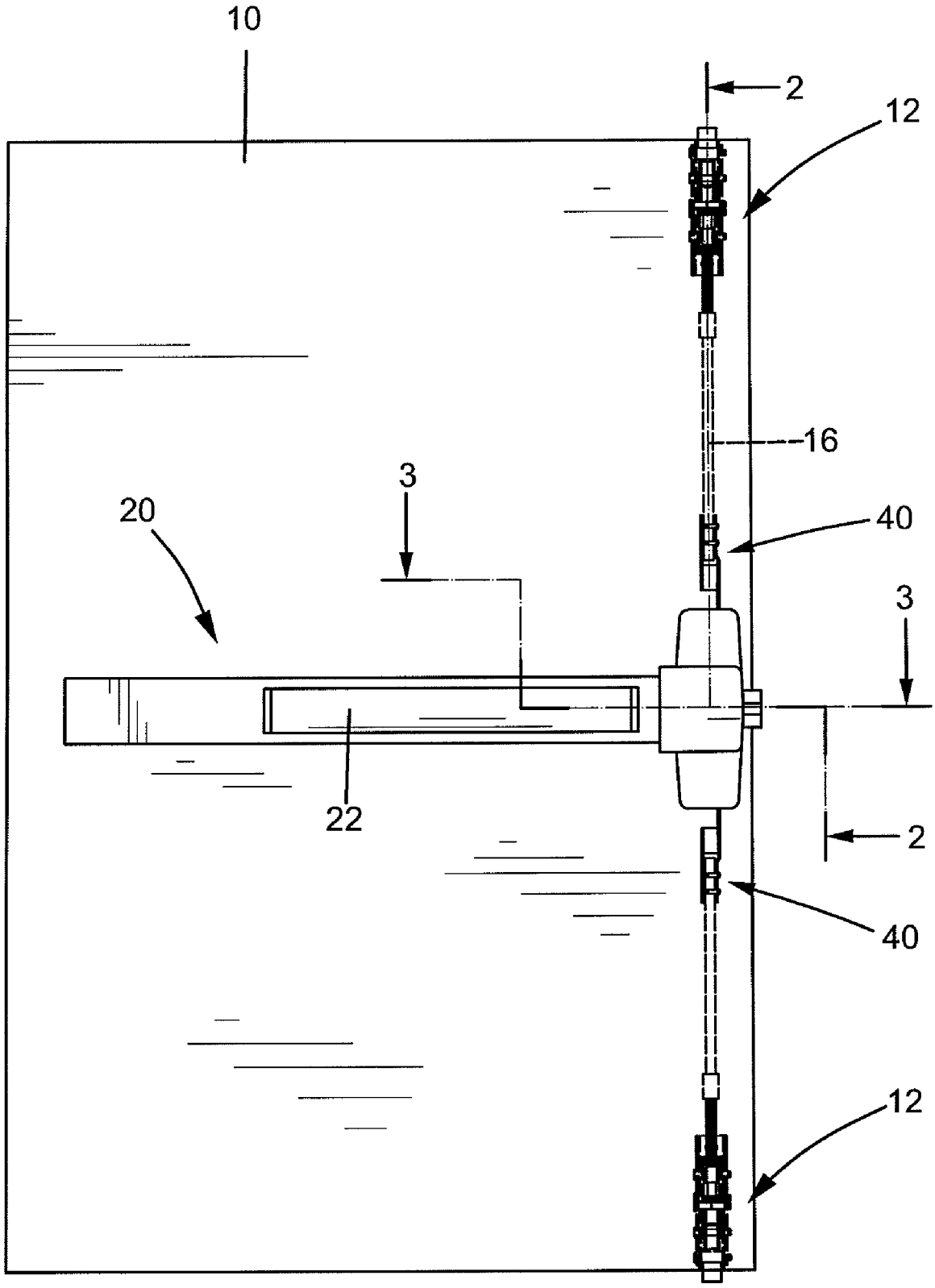
FIG. 1 shows a diagrammatic side view of a panic exit door and a lock mounted to the panic exit door and utilizing connecting devices according to the preferred teachings of the present invention.
Figure 2:
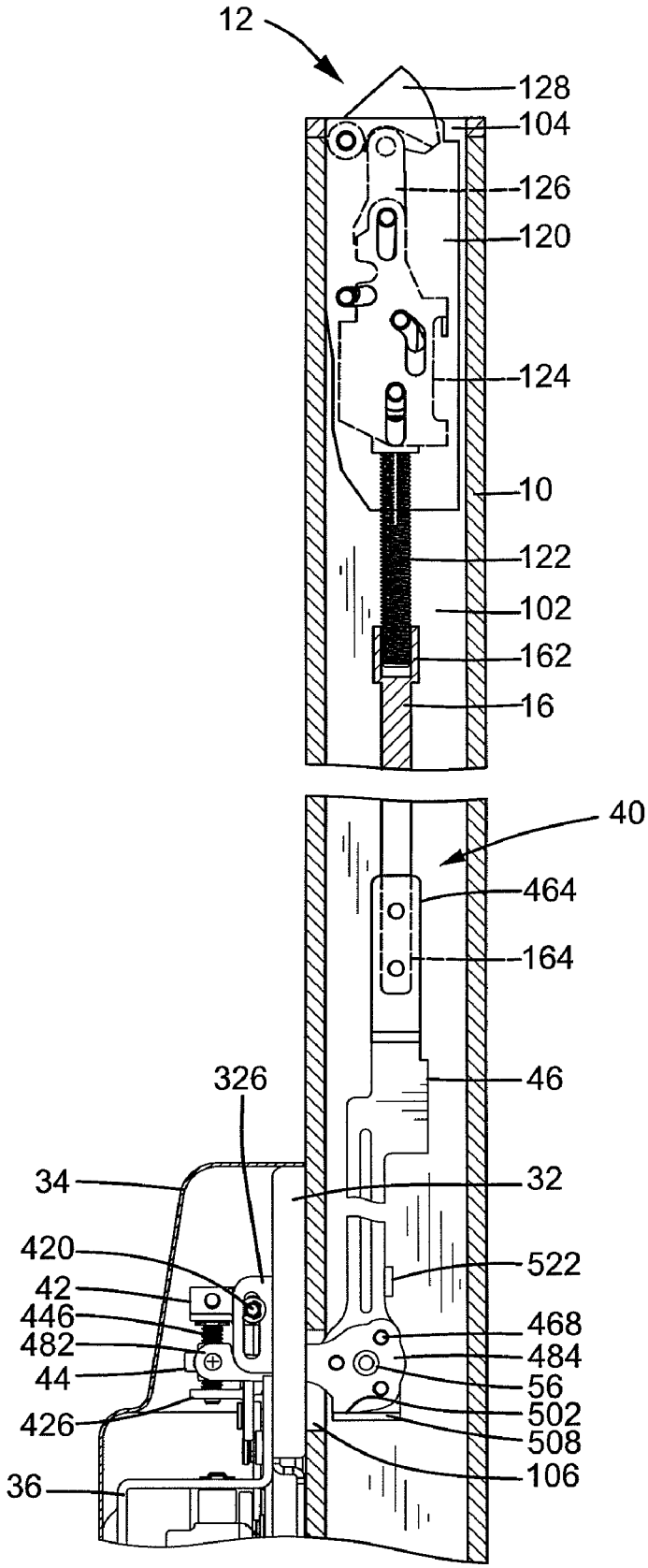
FIG. 2 shows a partial, cross-sectional view of the lock of FIG. 1 according to section line 2-2 of FIG. 1.
Figure 3:
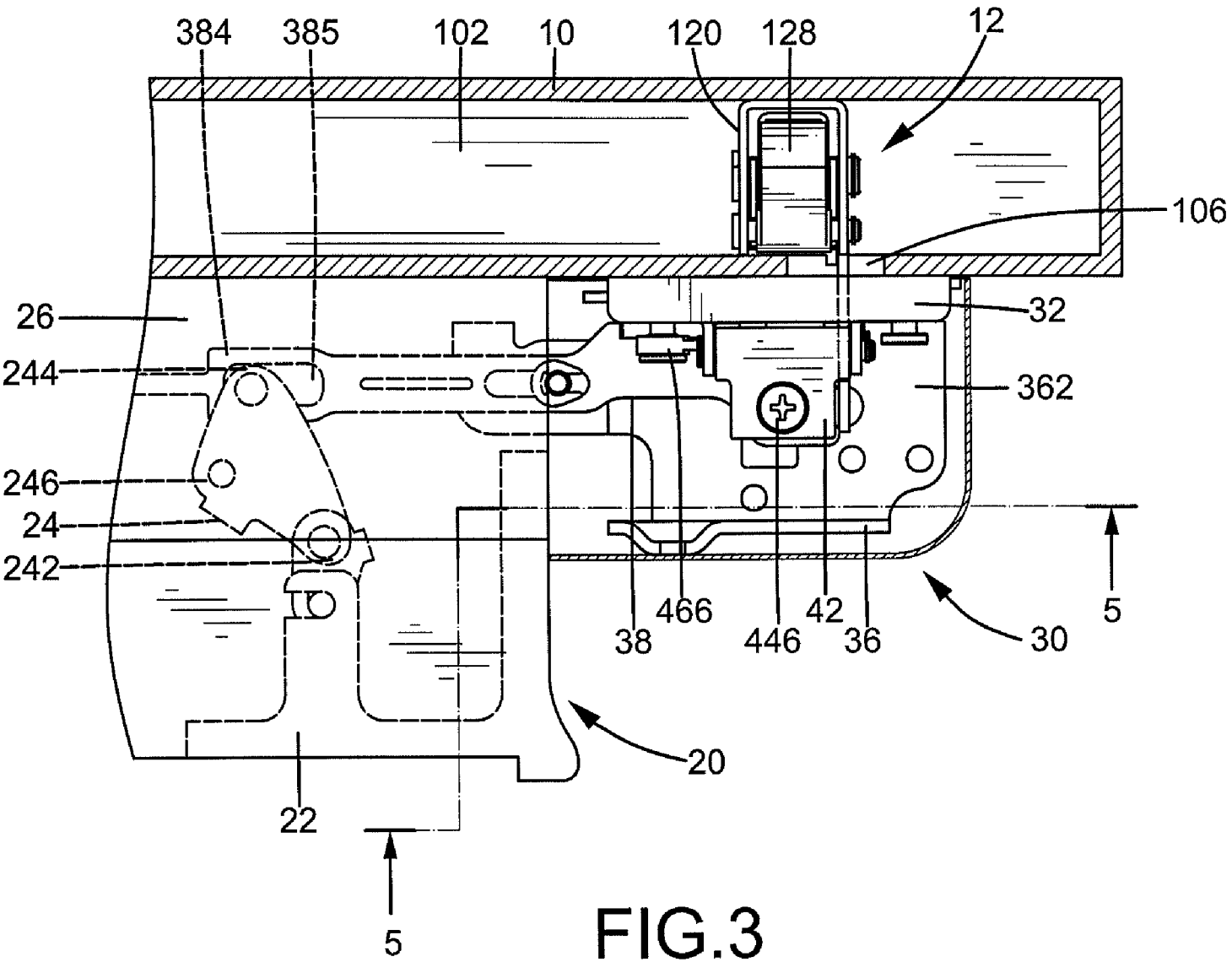
FIG. 3 shows a partial, cross-sectional view of the lock of FIG. 1 according to section line 3-3 of FIG. 1.
Figure 4:
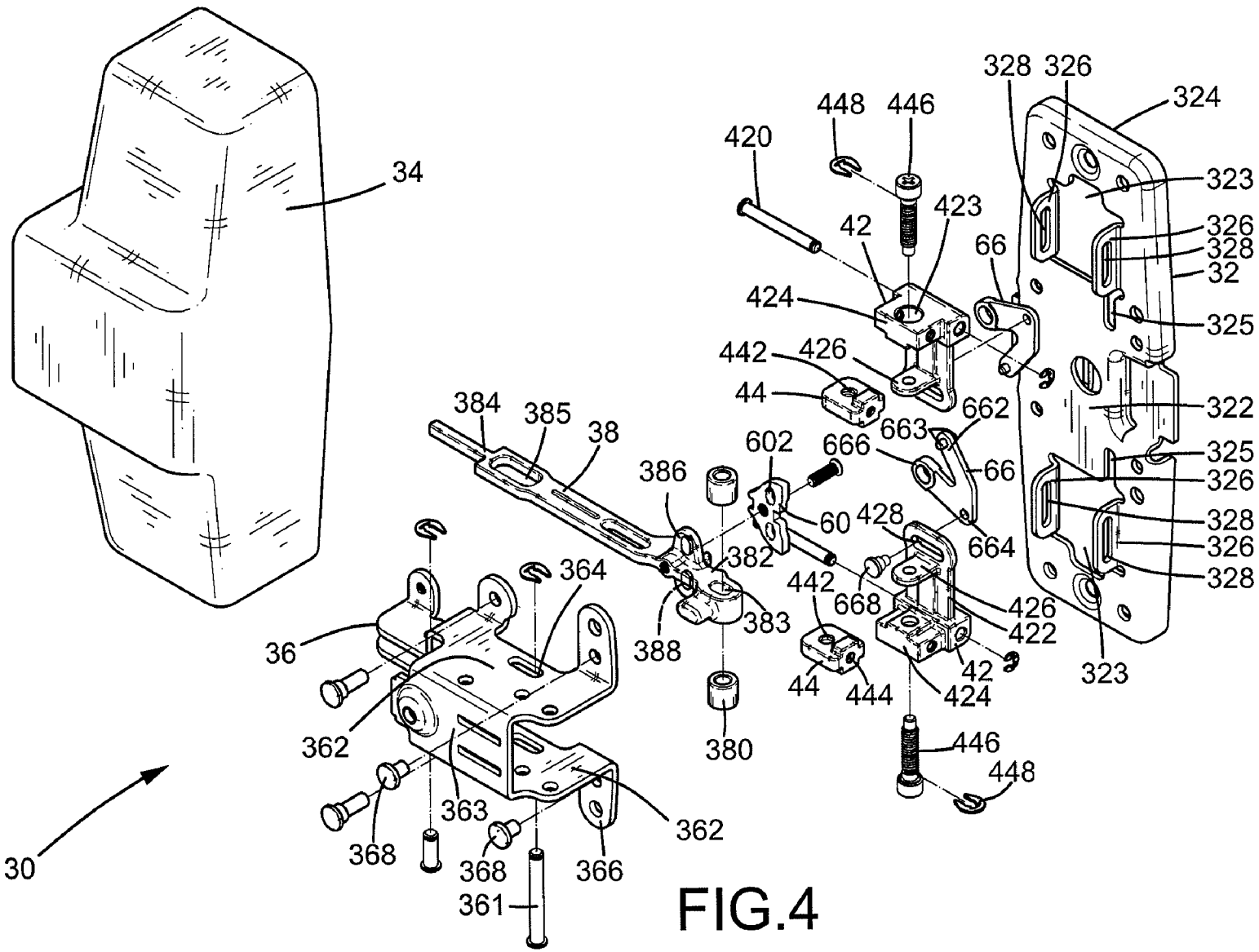
FIG. 4 shows a partial, exploded, perspective view of a follower device of the panic device of FIG. 1.
Figure 5:
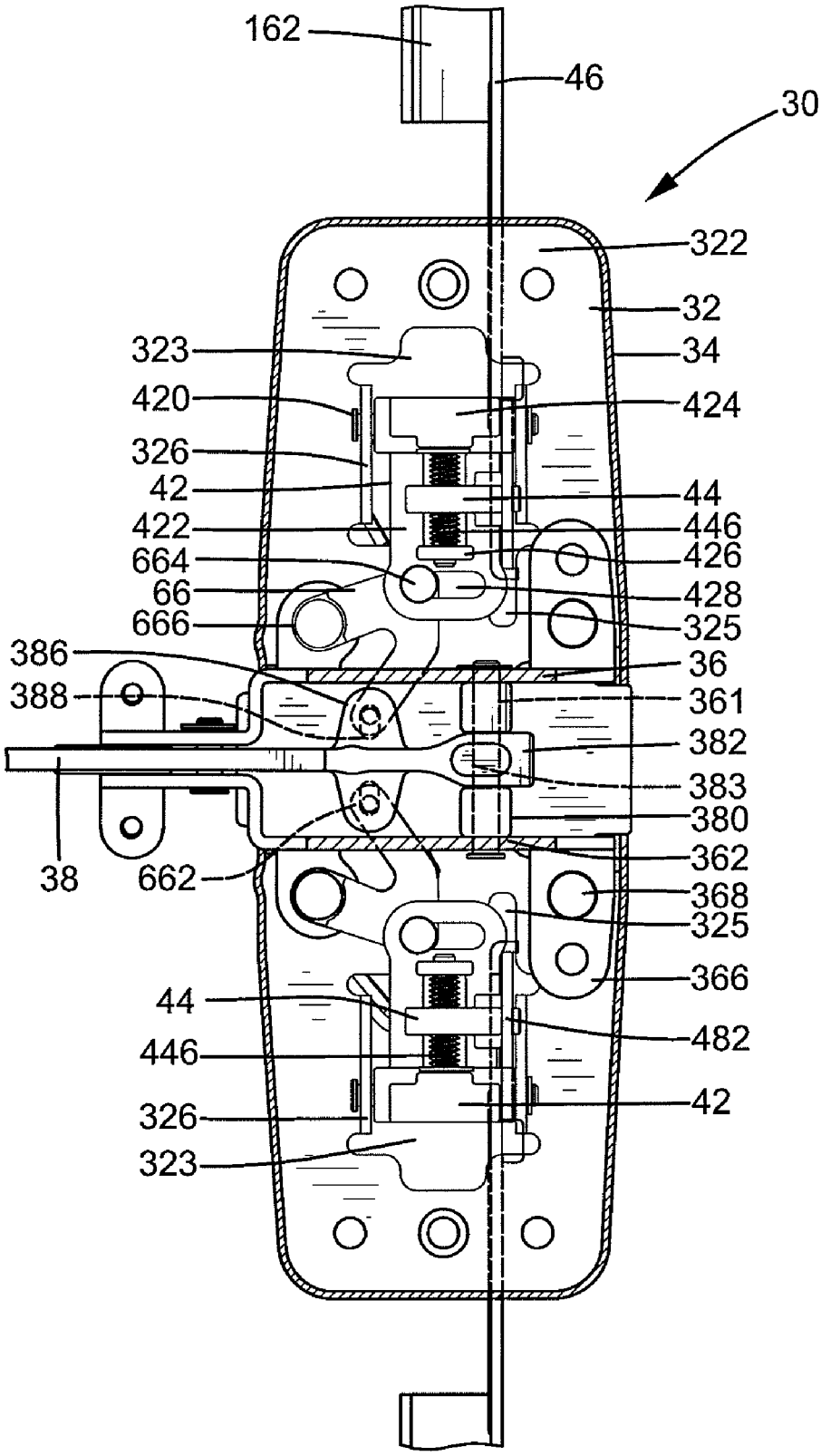
FIG. 5 shows a partial, cross-sectional view of the lock of FIG. 1 according to section line 5-5 of FIG. 3.
Figure 6:
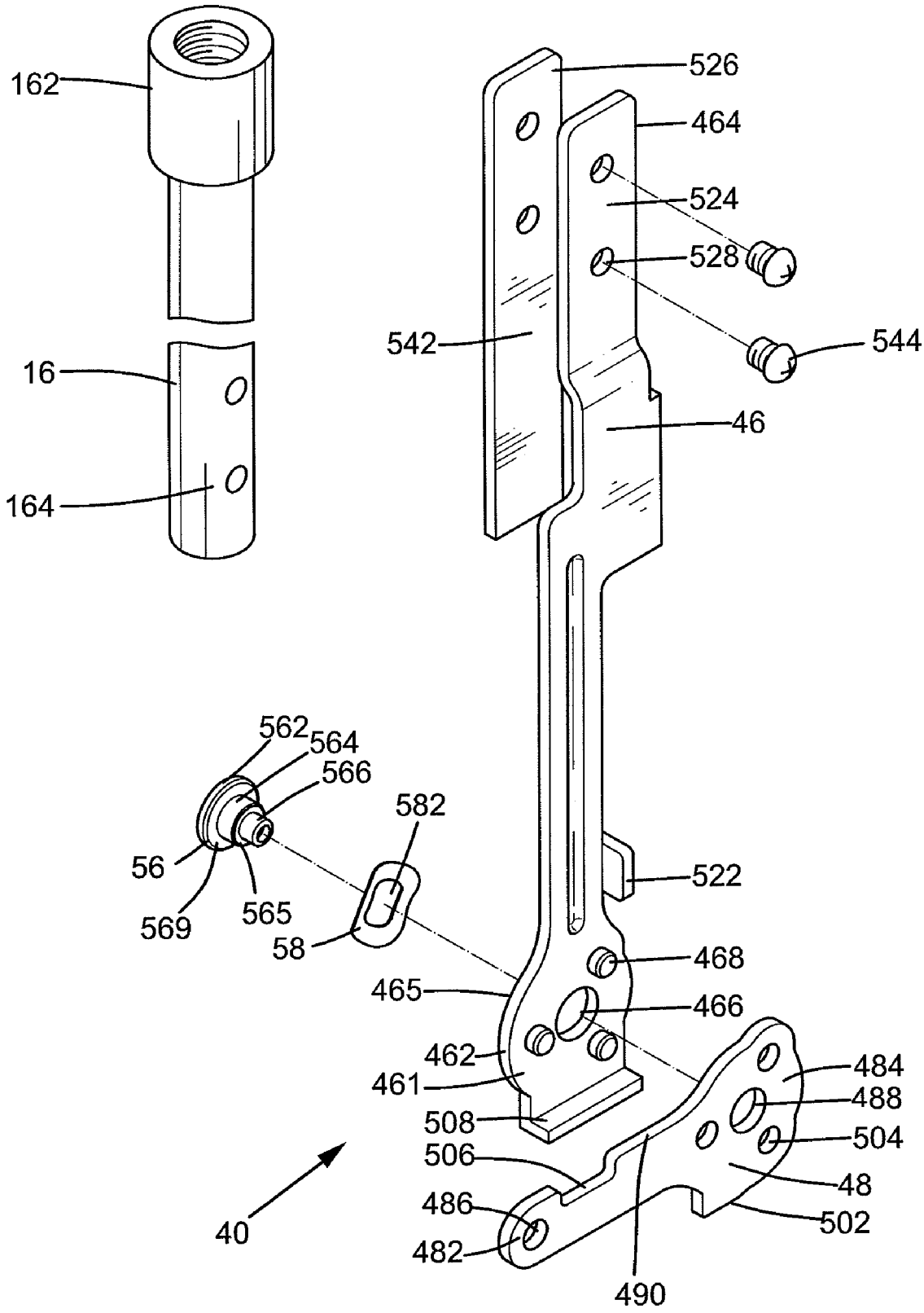
FIG. 6 shows an exploded, perspective view of a connecting device according to the preferred teachings of the present invention utilized in the lock of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "upper", "lower", "front", "rear", "inner", "end", "portion", "section", "longitudinal", "axial", "lateral", "horizontal", "vertical", "annular", "spacing", "length", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A connecting device according to the preferred teachings of the present invention is shown in the drawings and generally designated 40. Connecting device 40 is generally utilized with a panic device or lock mounted to a panic exit door 10. According to the preferred form shown, the lock mounted to door 10 includes an operative device 20, a follower device 30 operably connected to operative device 20, top and bottom latch devices 12 operably connected to follower device 30, and two connecting devices 40 according to the preferred teachings of the present invention. Operative device 20 and follower device 30 are mounted to an inner side of door 10. Door 10 is hollow and includes an interior space 102. Door 10 further includes an end opening 104 in each of a top edge and a bottom edge thereof. Door 10 further includes a side opening 106 in the inner side. End openings 104 and side opening 106 are in communication with interior space 102. According to the preferred form shown, each of top and bottom latch devices 12 are mounted into interior space 102 via one of end openings 104. Each of top and bottom latch devices 12 includes a body 120, a latch 128 pivotably connected to body 120, a follower 124 slideably mounted in body 120 in a vertical direction, and a linking member 126 having a first end coupled to follower 124 and a second end coupled to latch 128. Follower 124 is coupled to a screw rod 122 that can be moved to move latch 128 between an extended, locking position outside of door 1 and a retracted, unlocking position inside of door 1.

According to the preferred form shown, follower device 30 includes a base 32 fixed to the inner side of door 10 by fasteners such as screws, bolts, or the like. Specifically, base 32 includes a first side 322 and a second side 324 abutting the inner side of door 10. Base 32 further include upper and lower slots 323 spaced in the vertical direction. Parallel, spaced first and second tabs 326 are formed on two sides of upper slots 323 and include aligned vertical tracks 328 extending in the vertical direction and forming an upper guiding mechanism 320. Parallel, spaced third and fourth tabs 326 are formed on two sides of lower slots 323 and include aligned vertical tracks 328 extending in the vertical direction and forming a lower guiding mechanism 320. A sliding slot 325 extends from an edge of each of upper and lower slots 323 in the vertical direction.

According to the preferred form shown, an upper slide 42 is slideably mounted between first and second tabs 326 in the vertical direction, and a lower slide 42 is slideably mounted between third and fourth tabs 326 in the vertical direction. Each of upper and lower slides 42 includes a base portion 422 extending in the vertical direction, a support 426 extending perpendicularly from a side of base portion 422, a pivotal section 424 extending perpendicularly from the side of base portion 422 and spaced from support 426 in the vertical direction, and a groove 428 extending in a horizontal direction perpendicular to the vertical direction and spaced from support 426 in the vertical direction. Groove 428 has a spacing to pivotal section 424 larger than support 426. Pivotal section 424 includes a vertical hole 423. An upper axle 420 is extended through upper slide 42 and slideably extended through vertical tracks 328 of first and second tabs 326, allowing upper slide 42 to slide between first and second tabs 326 in the vertical direction. A lower axle 420 is extended through lower slide 42 and slideably extended through vertical tracks 328 of third and fourth tabs 326, allowing lower slide 42 to slide between third and fourth tabs 326 in the vertical direction, with grooves 428 adjacent to each other. An adjusting block 44 is mounted on each of upper and lower slides 42. Each adjusting block 44 includes a screw hole 442 extending in the vertical direction and a positioning hole 444 in the most preferred form shown as a screw hole extending in a direction perpendicular to the vertical direction.

According to the preferred form shown, follower device 30 further includes two adjusting screws 446 each extending through vertical hole 423 of pivotal section 424 of one of upper and lower slides 42 and through screw hole 442 of one of adjusting blocks 44. Each adjusting screw 446 is retained in place by a retainer 448 in the most preferred form shown as a C-clip allowing free rotation of adjusting screw 446 and preventing adjusting screw 446 from disengaging from pivotal section 424. Thus, when adjusting screws 446 are rotated, adjusting blocks 44 are moved along adjusting screws 446 in the vertical direction.

According to the preferred form shown, follower device 30 further includes a bracket 36 in the most preferred form shown as a substantially U-shaped structure having parallel, spaced first and second sidewalls 362 spaced in the vertical direction. Bracket 36 further includes an interconnecting wall 363 interconnected between first and second sidewalls 362. Each of first and second sidewalls 362 has a plurality of engaging portions 366. Fasteners 368 are extended through engaging portions 366 to fix bracket 36 to base 32. First and second sidewalls 362 further include aligned limiting slots 364.

According to the preferred form shown, a linking rod 38 is mounted between and spaced from first and second sidewalls 362 of bracket 36 in the vertical direction. Linking rod 38 includes front and rear ends 382 and 384 spaced in a longitudinal axis thereof perpendicular to the vertical direction. Front end 382 of linking rod 38 includes a slot 383. A limiting pin 361 is slideably extended through slots 364 of bracket 36 and slot 383 of linking rod 38. An upper limiting block 380 is mounted in a spacing between an upper face of front end 382 of linking rod 38 and first sidewall 362 of bracket 36, and a lower limiting block 380 is mounted in a spacing between a lower face of front end 382 of linking rod 38 and second sidewall 362 of bracket 36. Each of upper and lower blocks 380 have a length in the vertical direction equal to the spacing between linking rod 38 and sidewall 362 to assist in stable movement of linking rod 38 along the longitudinal axis between first and second sidewalls 362 of bracket 36. Upper and lower wings 386 are formed on linking rod 38 adjacent front end 382. Each of upper and lower wings 386 has a sliding groove 388 extending in the vertical direction. Linking rod 37 further includes a slot 385 adjacent to rear end 384.

According to the preferred form shown, operative device 20 includes a housing 26 fixed to the inner side of door 10 and an operative member 22 in the most preferred form shown as a press bar pivotably coupled to housing 26. A rocker 24 is mounted in housing 26 and includes a first corner 242 pivotably connected to operative member 22, a second corner 244 pivotably coupled with slot 385 of linking rod 38, and a third corner 246 pivotably connected to housing 26. When operative member 22 is operated (e.g., pressed), rocker 24 pivots to move linking rod 38 in an unlatching direction. Operative device 20 for actuating linking rod 38 can be of any desired form as conventional including but not limited to of a commercially available type.

According to the preferred form shown, follower device 30 further includes a plate 60 fixed to linking rod 38 and two substantially V-shaped links 66. Plate 60 includes upper and lower grooves 602 aligned with sliding grooves 388 of wings 38. Each link 66 has a first end 662, a second end 666 pivotably connected to one of engaging portions 366 of bracket 36, and an intermediate portion 664. First end 662 of each link 66 includes first and second pegs 663 on two faces thereof. First peg 663 of each link 66 is slideably received in sliding groove 388 of one of wings 386. Second peg 663 of each link 66 is slideably received in one of upper and lower grooves 602 of plate 60. Follower device 30 further includes two pins 668 each extending through intermediate portion 664 of one of links 66 and slideably extending through groove 428 of one of upper and lower slides 42. Thus, intermediate portion 664 of each link 66 is pivotable relative to one of upper and lower slides 42 and slideable along groove 428 of one of upper and lower slides 42. When linking rod 38 is moved along the longitudinal axis, links 66 are rotated to move upper and lower slides 42 toward or away from each other in the vertical direction, moving top and bottom latch devices 12.

According to the preferred form shown, two connecting devices 40 according to the preferred teachings of the present invention are provided for top and bottom latch devices 12. According to the most preferred form shown, connecting devices 40 are identical so that description of one of them is sufficient. Connecting device 40 includes a connecting member 46 having first and second ends 462 and 464. According to the most preferred form shown, second end 464 of connecting member 46 includes parallel, spaced first and second side plates 524 and 526 forming a compartment 542 therebetween. First and second side plates 524 and 526 include aligned holes 528. A connecting rod 16 includes a first end 162 threadedly connected to screw rod 122 of latch device 12 and a second end 164 received in compartment 542. Fasteners 544 are extended through holes 528 and holes in second end 164 of connecting rod 16 to couple second end 464 of connecting member 46 to second end 164 of connecting rod 16. Thus, latch 128 is moved when connecting device 40 is moved. First end 462 of connecting member 46 includes first and second faces 461 and 465. A through-hole 466 extends from first face 461 through second face 465. Three annularly spaced pegs 468 are formed on first face 461 and surround through-hole 466. Connecting member 46 further includes a stop piece 522 extending perpendicularly from first face 461. Stop piece 522 is perpendicular to the vertical direction. Furthermore, a stop wall 508 extends perpendicularly from first face 461 of first end 462 of connecting member 46. Stop wall 508 is perpendicular to stop piece 522 and to the vertical direction.

According to the preferred form shown, connecting device 40 further includes a draw rod 48 having first and second ends 482 and 484. Draw rod 48 includes a first end 482 having a hole 486 extending from a first side through a second side of draw rod 48. Draw rod 48 further includes a second end 484 having a pin hole 488 aligned with through-hole 466 of connecting member 46. Pin hole 488 has a diameter smaller than that of through-hole 466. Second end 484 of draw rod 48 further includes three annularly spaced positioning holes 504 extending from the first side through the second side of draw rod 48 and surrounding pin hole 488. Draw rod 48 further includes a notch 506 in a face 490 thereof adjacent to first end 482. Further, draw rod 48 includes a stop face 502 opposite to the face in which notch 506 is formed. Face 490 and stop face 502 extend between and are perpendicular to the first and second sides of draw rod 48. Notch 506 is provided to avoid interference to operation of components such as slides 42 of follower device 30.

Figure 7:
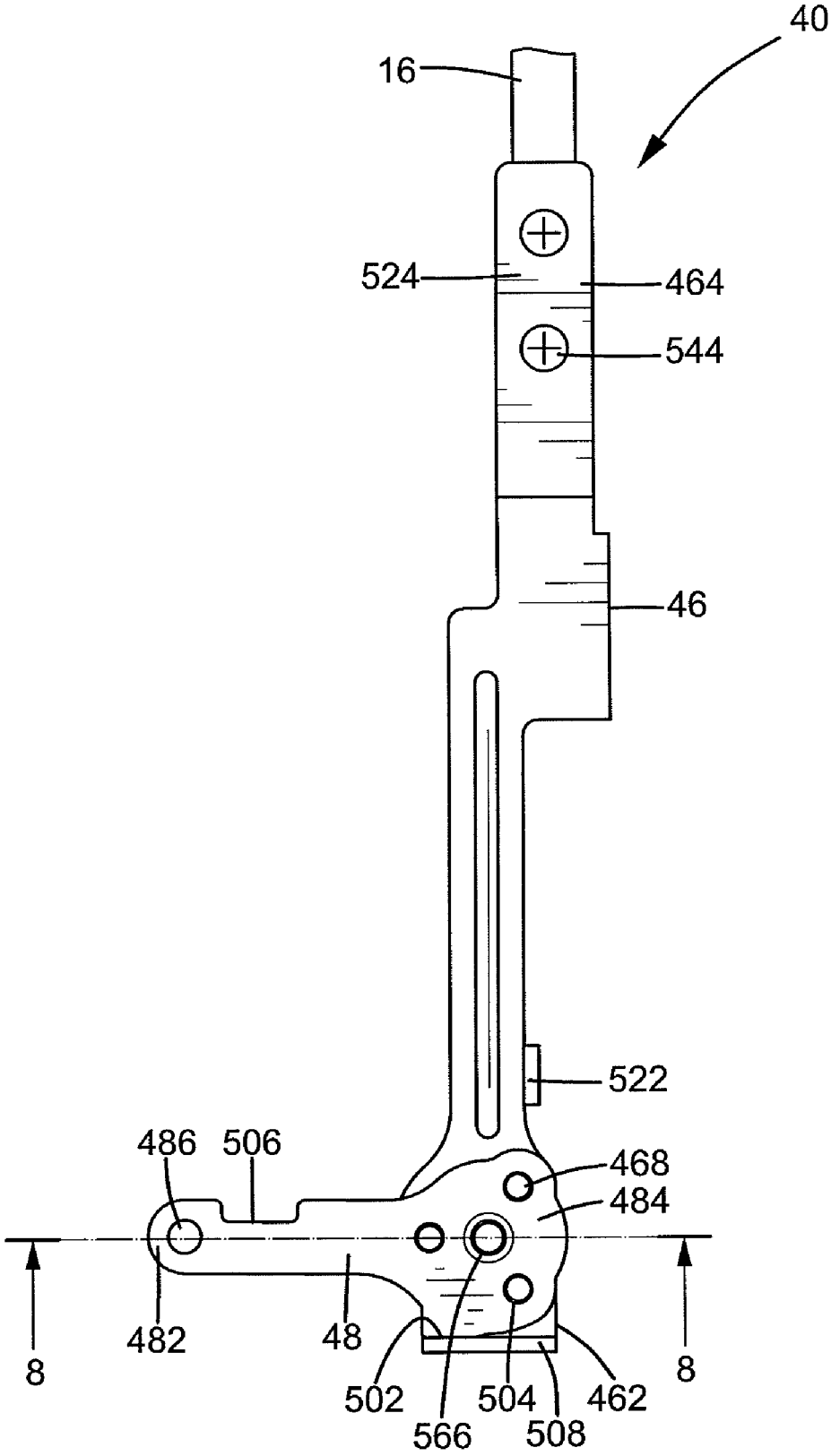
FIG. 7 shows a side view of the connecting device of FIG. 6 with the connecting device in a coupling position.
Figure 8:
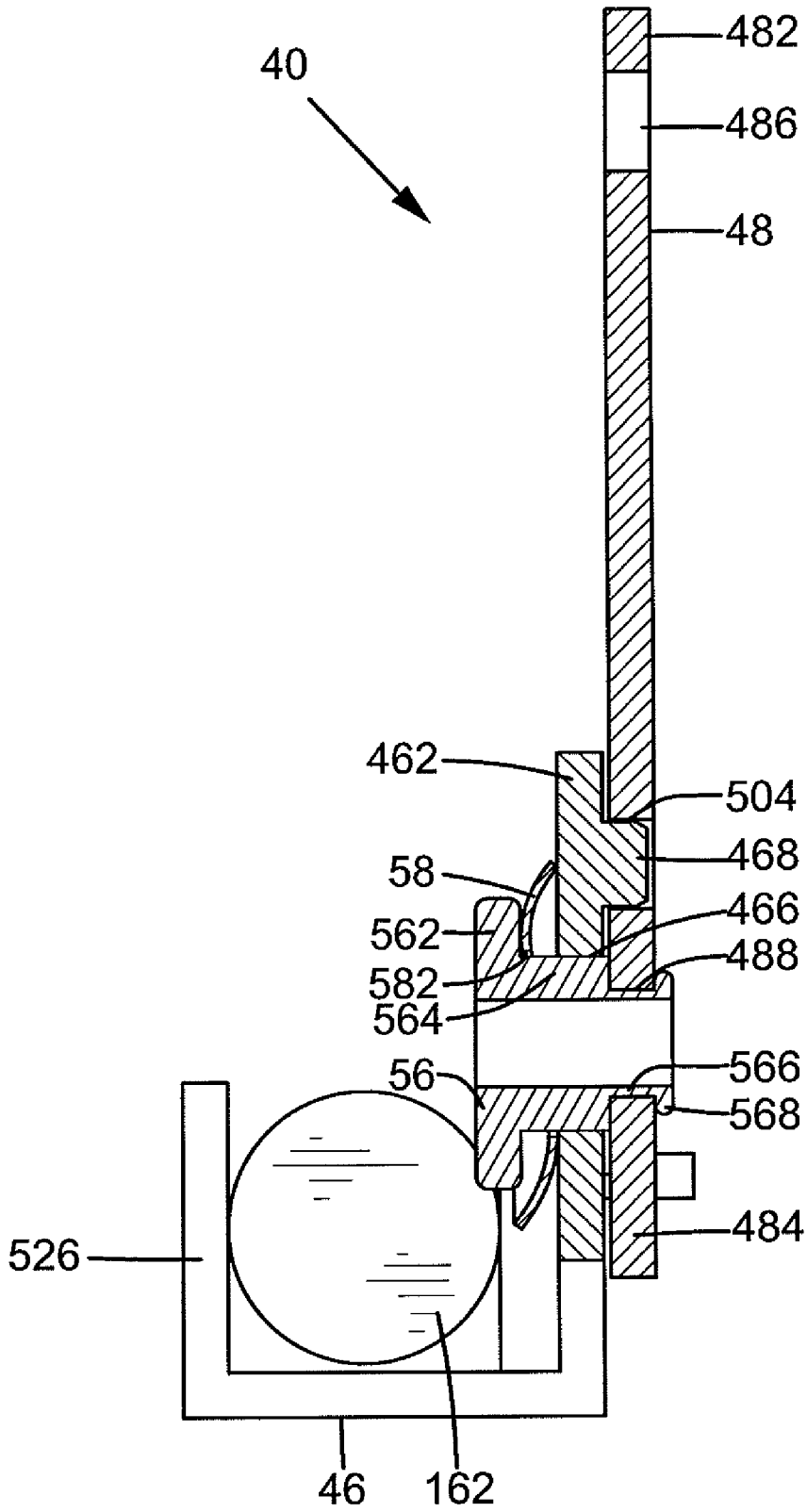
FIG. 8 shows a cross-sectional view of the connecting device of FIG. 7 according to section line 8-8 of FIG. 7 with a connecting member and a draw rod of the connecting device engaged with each other.
Figure 9:
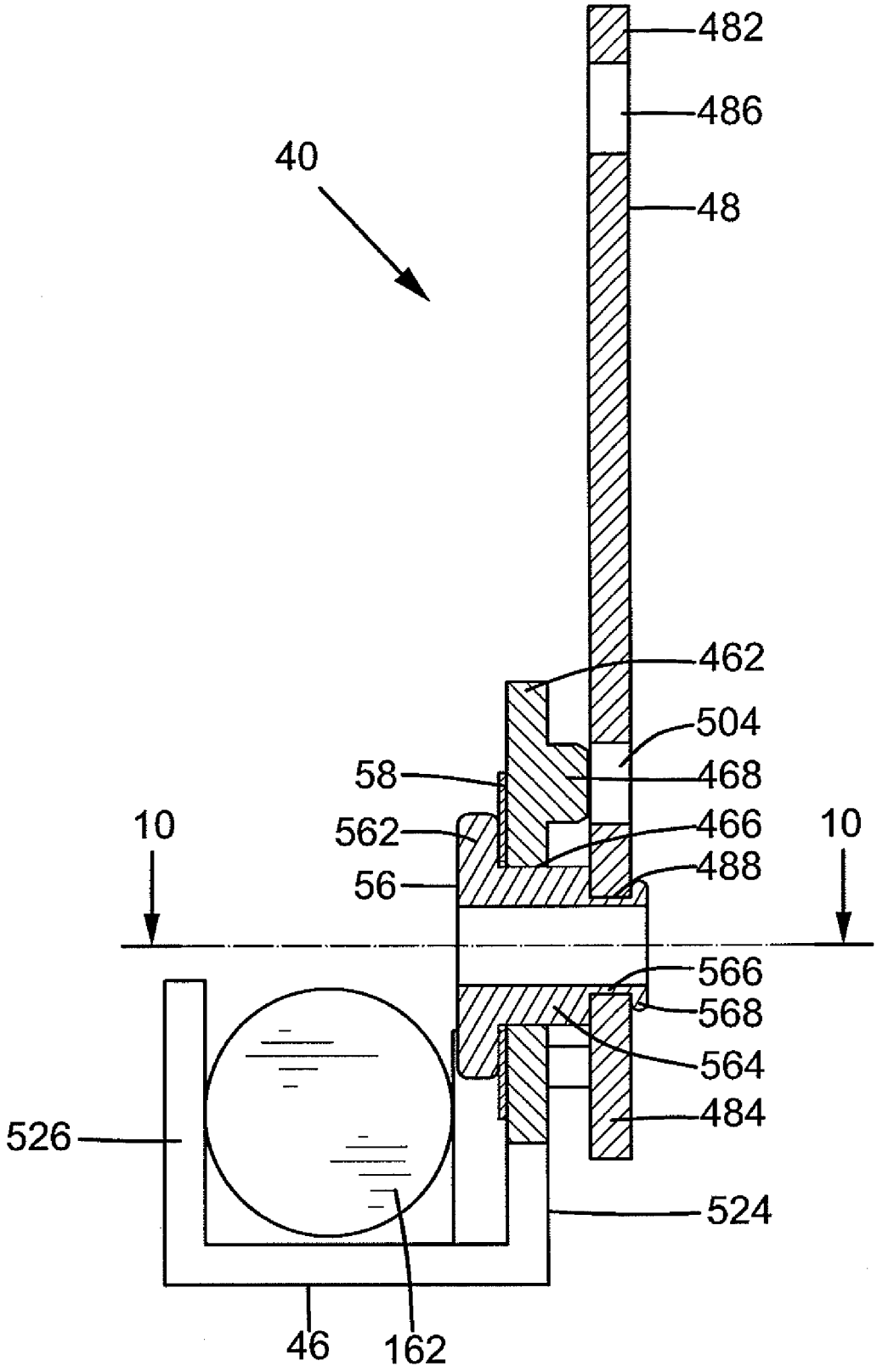
FIG. 9 shows a cross-sectional view of the connecting device of FIG. 7 according to section line 8-8 of FIG. 7 with a pin pressed to disengage the draw rod from the connecting member so as to allow pivotal movement of the draw rod relative to the connecting member.
Figure 10:
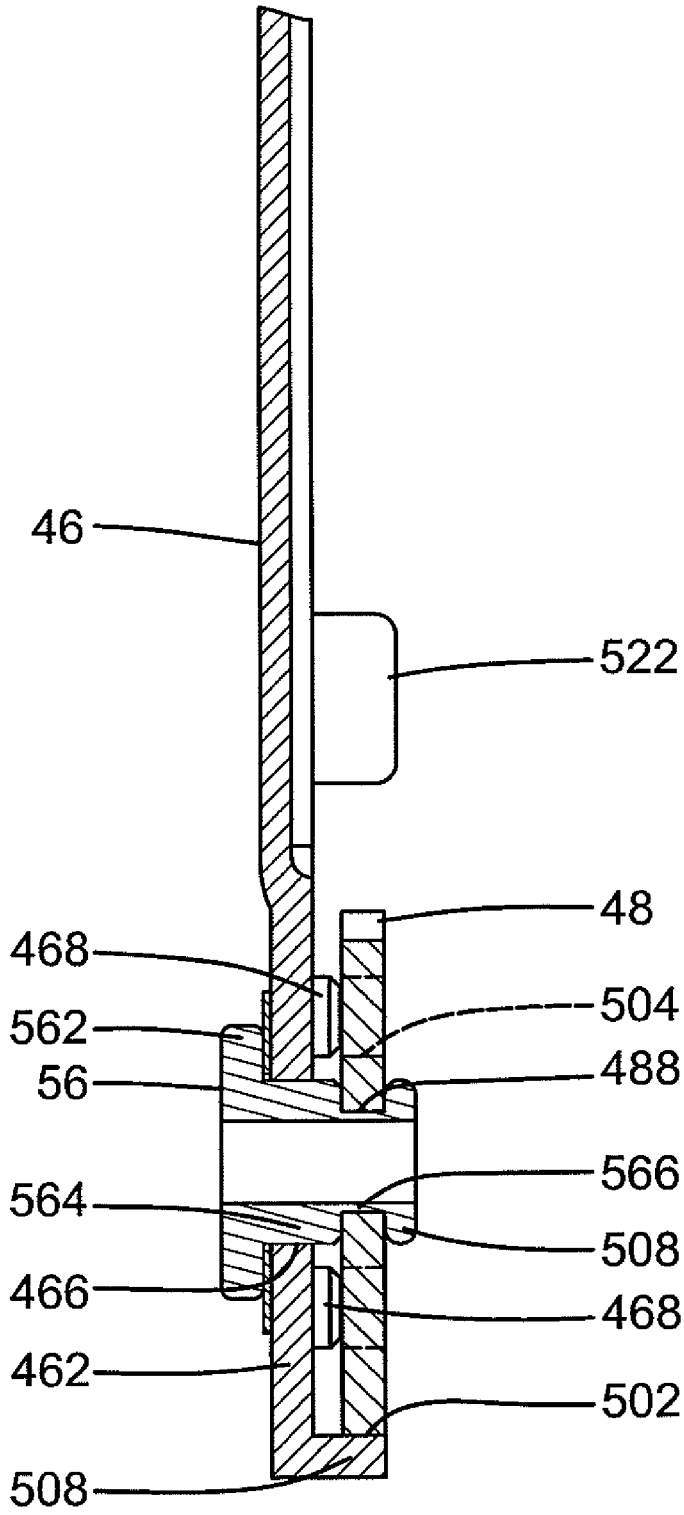
FIG. 10 shows a cross-sectional view of the connecting device of FIG. 7 according to section line 10-10 of FIG. 9.
Figure 11:
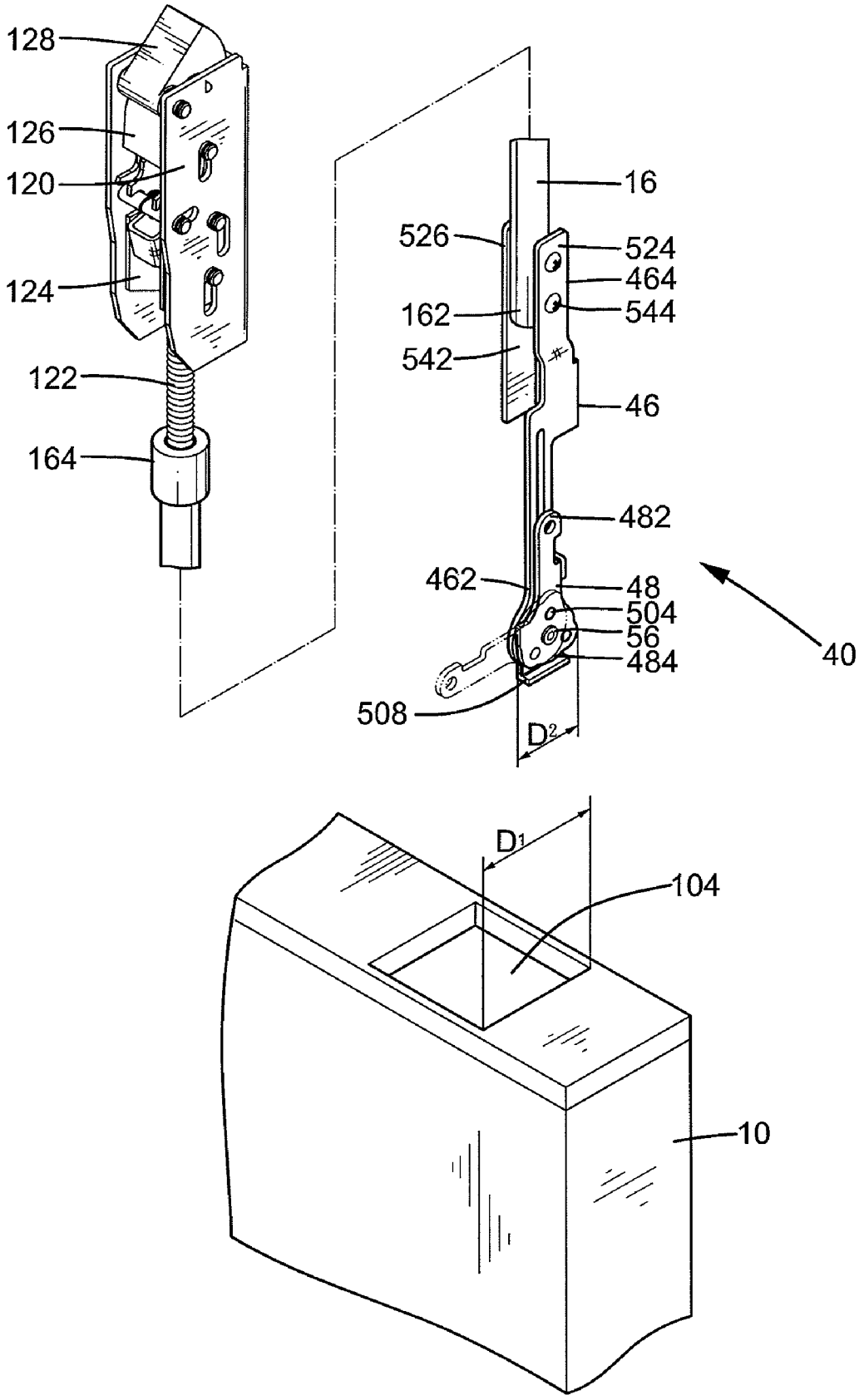
FIG. 11 shows a partial, exploded, perspective view of the door, a top latch, and the connecting device of FIG. 1, illustrating mounting of the connecting device and the top latch via an end opening in a top face of the door.

According to the preferred form shown, second end 484 of draw rod 48 is pivotably coupled to first end 462 of connecting member 46 by a pin 56 extending through through-hole 466 of connecting member 46 and pin hole 488 of draw rod 48. According to the most preferred form shown, pin 56 includes a head 562 and a shank 569 extending from a side of head 562. Shank 569 includes a first shank portion 564 extending from the side of head 562 and a second shank portion 566 extending from an end face 565 of first shank portion 564 and having a diameter smaller than that of first shank portion 564. First shank portion 564 slideably extends through through-hole 466 of connecting member 46 and has a diameter the same as that of through-hole 466. Second shank portion 566 extends through pin hole 488 of draw rod 48 and has a diameter the same as pin hole 488 (FIG. 8). A resilient plate 582 having S-shaped cross sections is mounted between the side of head 56 and second face 465 of connecting member 46. Resilient plate 58 includes an opening 582 through which first shank portion 564 extends. Opening 582 has a diameter that is the same as first shank portion 564 when resilient plate 58 is flattened. A distal end 568 of second shank portion 566 extending beyond second end 484 of draw rod 48 is enlarged such as by riveting to have a diameter larger than that of pin hole 488, preventing disengagement of pin 56 from connecting member 46 and draw rod 48. Thus, second end 484 of draw rod 48 is sandwiched between end face 565 of first shank portion 564 and distal end 568 of second shank portion 566 (FIG. 8). Pin 56 is movable relative to connecting member 46 in an axial direction of shank 569 between a compressing position compressing resilient plate 58 and a non-compressing position not compressing resilient plate 58. Pin 56 is initially in the non-compressing position due to resiliency of resilient plate 58. When pin 56 is pressed in a direction toward connecting member 46 and moves from the non-compressing position to the compressing position, resilient plate 58 deforms so that it is flattened (FIG. 9). At the same time, draw rod 48 is moved together with pin 56 in an axial direction of shank 569, so that positioning holes 484 of draw rod 48 are disengaged form pegs 468 of connecting member 46. In this state, draw rod 48 is pivotable between a first position in which draw rod 48 is parallel to connecting member 46 (FIG. 11) and a second position in which draw rod 48 is perpendicular to connecting member 46 (FIG. 7). When draw rod 48 is in the first position, face 490 of draw rod 48 abuts with stop piece 522 of connecting member 46 to prevent further rotation of draw rod 48. Furthermore, positioning holes 504 of draw rod 48 are not aligned with pegs 468 of connecting member 46, so that pegs 468 press against the first side of draw rod 48 to retain resilient plate 58 in a compressed state. On the other hand, when draw rod 48 is in the second position, stop face 502 of draw rod 48 abuts with stop wall 508 of connecting member 46, preventing further rotation of draw rod 48 relative to connecting member 46. Furthermore, positioning holes 504 of draw rod 48 are aligned with pegs 468 of connecting member 46, so that draw rod 48 is moved in the axial direction toward connecting member 46 by the resiliency of resilient plate 58. As a result, positioning holes 504 of draw rod 48 are engaged with pegs 468 of connecting member 46, preventing rotation of draw rod 48 relative to connecting member 46. Namely, draw rod 48 is retained in the second position perpendicular to connecting member 46. It is noted that displacement of draw rod 48 in the axial direction of shank 569 of pin 56 due to pressing of pin 56 is smaller than a width of stop wall 508 in the axial direction (i.e., the width of the stop wall 508 is larger than a spacing between the compressing position and the non-compressing position of pin 56). Thus, pivotal movement of draw rod 48 is limited between the first and second positions defined by stop wall 508 of stop piece 522 of connecting member 56.

Figure 12:
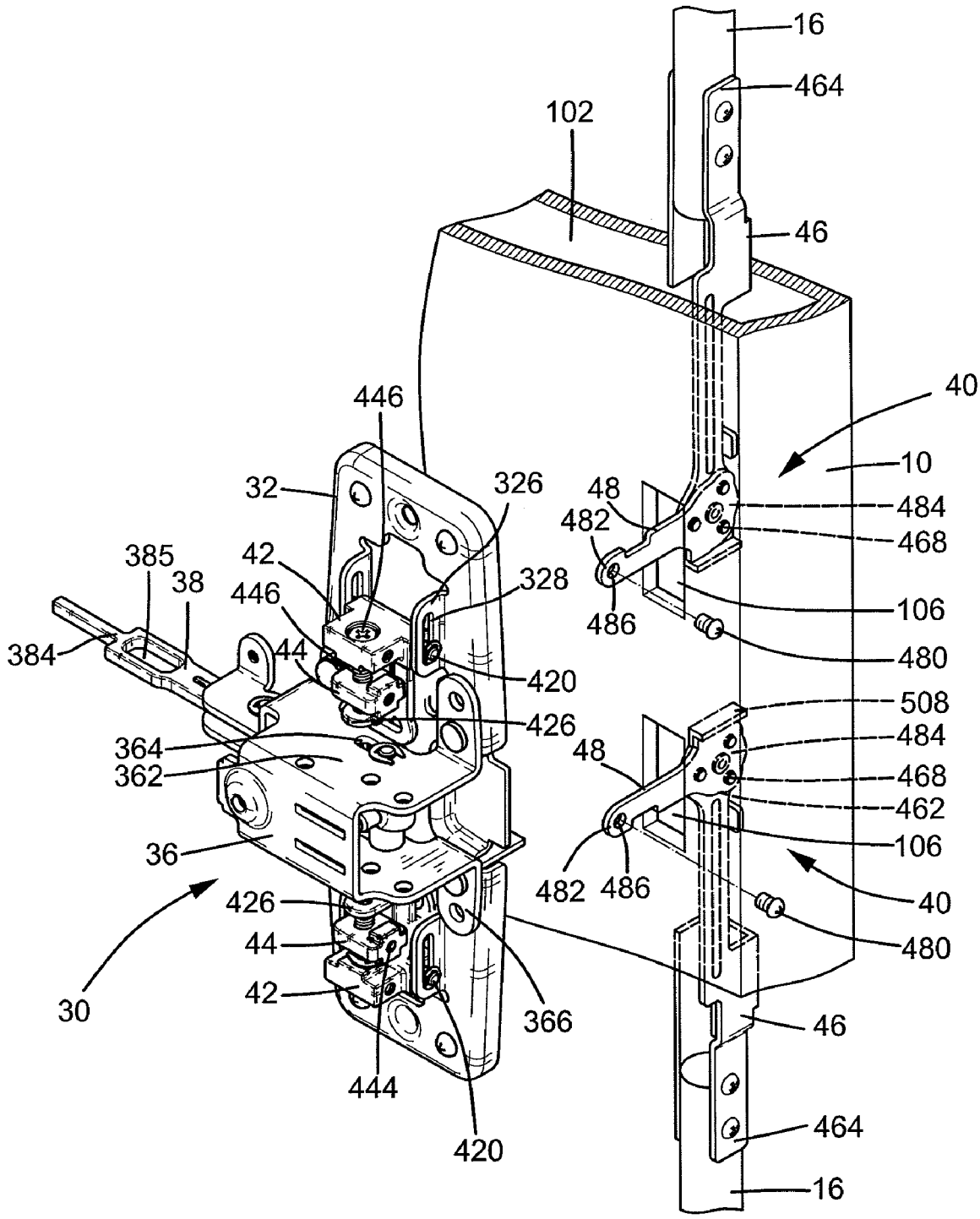
FIG. 12 shows a partial, exploded, perspective view of the door and the lock of FIG. 1 with the draw member of each connecting device in a position ready for coupling with the follower device.

In installation, draw rod 48 is moved to the first position (FIG. 11), so that a maximum width D2 of connecting device 40 in a width direction perpendicular to the vertical direction is smaller than a width D1 of end opening 104 of door 10 in the width direction perpendicular to the vertical direction. Thus, each connecting device 40 can be inserted through end opening 104 of door 10 into interior space 102 of door 10. When draw rod 48 of each connecting device 40 reaches a position aligned with side opening 106 of door 16, draw rod 48 is pivoted to the second position (FIG. 12), so that first end 482 of draw rod 48 extends out of door 10 via side opening 106. First end 482 of draw rod 48 is coupled to one of adjusting blocks 44 by extending a fastener 480 through hole 486 of draw rod 48 into positioning hole 444 of adjusting block 44. Note that each draw rod 48 is extended through one of slots 323.

In a case that first ends 482 of draw rods 48 can not be coupled with adjusting blocks 44 due to installation error, connecting rods 16 can be rotated to control the length of each screw rod 122 coupled with first end 162 of each connecting rod 16 until first end 482 of each draw rod 48 reaches a position capable of coupling with one of adjusting blocks 44. It can be appreciated that connecting devices 40 rotate during such adjustment without interfering with walls of interior space 102 of door 10. Thus, installation and adjustment of connecting devices 40 can easily be accomplished by only one installer.

Figure 13:
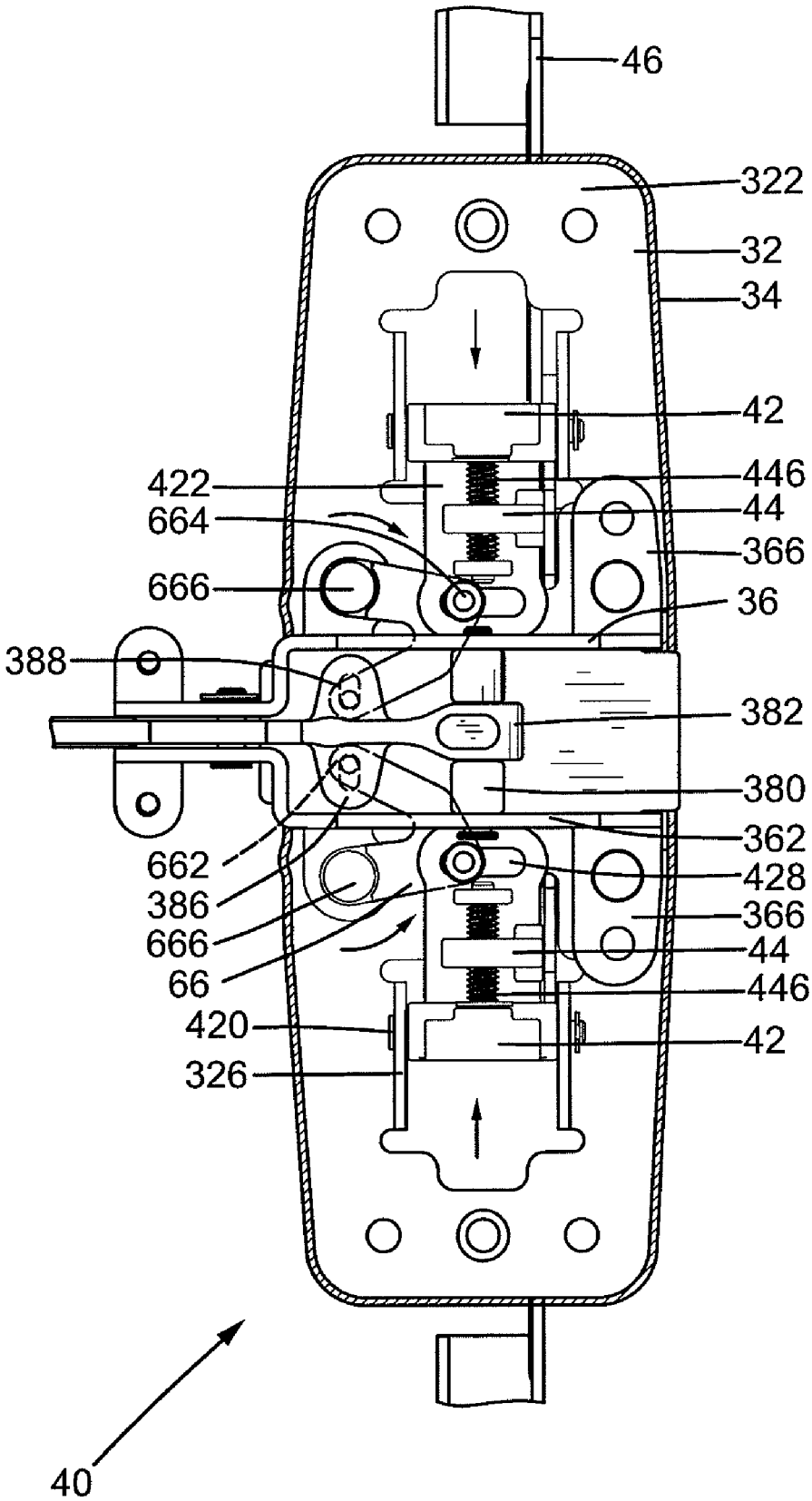
FIG. 13 shows a partial, cross-sectional view of the panic device of FIG. 1 with a linking rod moved to pivot two links for unlatching purposes.
Figure 14:
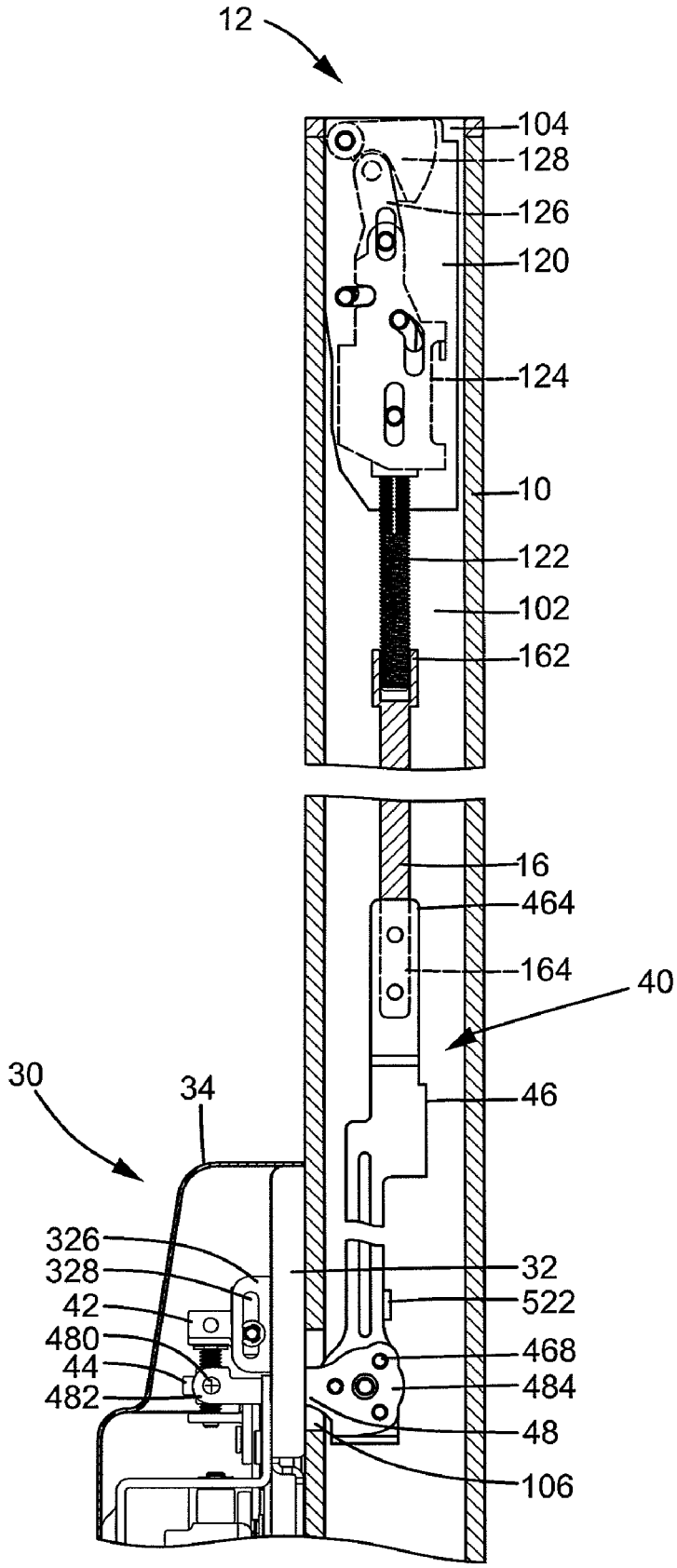
FIG. 14 shows a partial, cross-sectional view of the panic device of FIG. 1 with the top latch moved to a retracted, unlocking position.
Figure 15:
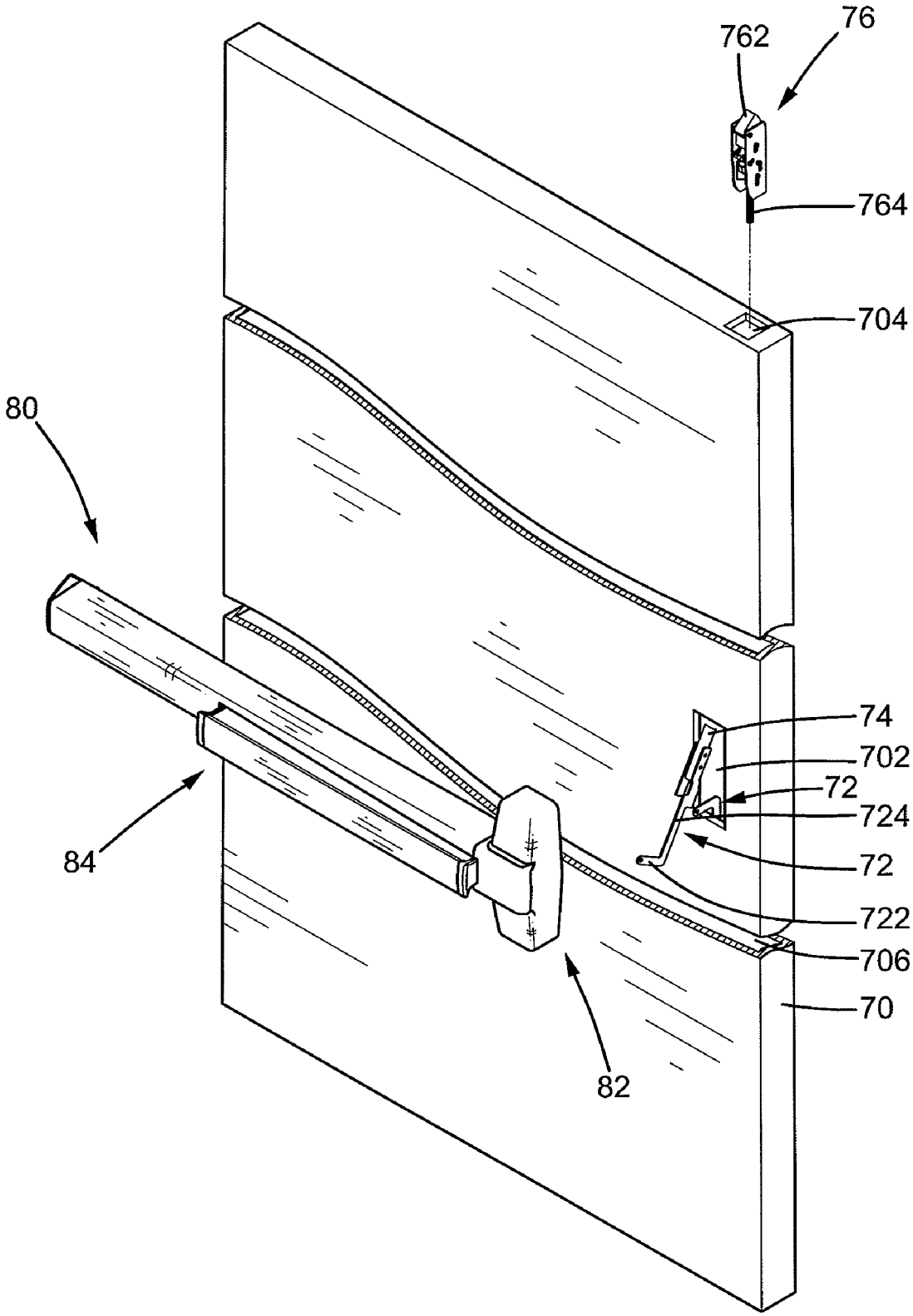
PRIOR ART FIG.15
FIG. 15 shows a perspective view of a panic exit door and a conventional lock, illustrating mounting of a connecting device and a latch of the lock to the panic exit door.

In operation, when linking rod 38 is moved in the unlatching direction such as due to pressing of operative member 22, links 66 are pivoted in directions indicated by arrows shown in FIG. 13 to move upper and lower slides 42 toward each other. Adjusting blocks 44 are moved toward each other to move connecting devices 40 toward each other. Latches 128 are, thus, moved to the retracted, unlocking positions. Note that sliding slots 325 allow movement of draw rods 48 in the vertical direction. When operative member 22 is released, linking rod 30 is moved in a latching direction to return latches 128 to the extended, locking positions. Since draw rod 48 is retained in the second position by engagement between positioning holes 504 of draw rod 48 and pegs 468 of connecting member 46, rotation of draw rod 48 in the second position is not permitted to assure reliable operation.

Now that the basic teachings of the present invention have been explained, many extensions and variations will be obvious to one having ordinary skill in the art. For example, connecting device 40 according to the preferred teachings of the present invention can be utilized with follower device 30 of any desired form as conventional including but not limited to of a commercially available type. Furthermore, connecting device 40 according to the preferred teachings of the present invention can be utilized with top or bottom latch device 12 of any desired form as conventional including but not limited to of a commercially available type. Furthermore, more or a fewer number of pegs 468 can be formed on connecting member 46, and the number and position of positioning hole 504 can be arranged to correspond to pegs 468. Stop wall 508 of connecting member 46 can be omitted without adversely affecting positioning of draw rod 48. Second end 464 of connecting member 46 can be in the form of a single piece directly coupled with connecting rod 16 by suitable manners including but not limited to fasteners.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A connecting device for a concealed latch of a lock for a panic exit door comprising, in combination:

a connecting member including a first end and a second end, with the second end of the connecting member being adapted to be operably coupled to the concealed latch of the lock, so that movement of the connecting member in a vertical direction causes pivotal movement of the latch between an extended, locking position and a retracted, unlocking position; and a draw rod including a first end and a second end, with the second end of the draw rod being pivotably coupled to the first end of the connecting member and pivotable between a first position and a second position, with the draw rod being parallel to the connecting member when in the first position and perpendicular to the connecting member when in the second position, with the first end of the draw rod being adapted to be operably coupled to an operative member of the lock when the draw rod is in the second position, with operation of the operative member causing movement of the connecting member in the vertical direction, with the first end of the connecting member including first and second faces and a through-hole extending from the first face through the second face, with a plurality of pegs being formed on the first face of the first end of the connecting member, with the second end of the draw rod including first and second sides and a pin hole extending from the first side through the second side and aligned with the through-hole, with the second end of the draw rod further including a plurality of positioning holes, with the connecting device further comprising, in combination: a pin including a head and a shank extending from a side of the head, with the shank extending through the through-hole and the pin hole, and with the plurality of positioning holes being engaged with the plurality of pegs when the draw rod is in the second position.

2. The connecting device as claimed in claim 1, further comprising, in combination: a resilient plate mounted between the side of the head and the second face of the first end of the connecting member, with the pin being slideable relative to the connecting member in an axial direction of the shank between a compressing position compressing the resilient plate and a non-compressing position not compressing the resilient plate, with the pin being in the non-compressing position when the draw rod is in the second position, with the plurality of pegs being disengaged from the plurality of positioning holes and pressing against the first side of the second end of the draw rod and with the pin in the compressing position when the draw rod is in the first position.

3. The connecting device as claimed in claim 2, with the shank including a first shank portion extending from the side of the head and a second shank portion extending from an end face of the first shank portion, with the first shank portion slideably extending through the through-hole of the connecting member, with the second shank portion extending through the pin hole of the draw rod, with the second shank portion including a distal end having a diameter larger than that of the pin hole of the draw rod, with the second end of the draw rod being sandwiched between the end face of the first shank portion and the distal end of the second shank portion, with the second end of the draw rod being moved away from the first end of the connecting member in the axial direction when the pin is moved from the non-compressing position to the compressing position, disengaging the plurality of positioning holes from the plurality of pegs.

4. The connecting device as claimed in claim 3, with the first end of the connecting member further including on the first face thereof the plurality of pegs being annularly spaced from one another and surrounding the through-hole, with the second end of the draw rod further including the plurality of positioning holes, being annularly spaced from one another and surrounding the pin hole, with the plurality of positioning holes being engaged with the plurality of pegs when the draw rod is in the second position, with the plurality of pegs being disengaged from the plurality of positioning holes and pressing against the first side of the second end of the draw rod and with the pin in the compressing position when the draw rod is in the first position.

5. The connecting device as claimed in claim 3, with the first end of the connecting member further including a stop wall extending perpendicularly from the first face, with the draw rod including a stop face extending between the first and second sides thereof, with the stop face of the draw rod abutting with the stop wall of the connecting member when the draw rod is in the second position, preventing further rotation of the draw rod relative to the connecting member.

6. The connecting device as claimed in claim 5, with the stop wall having a width in a direction parallel to the axial direction, with the width of the stop wall being larger than a spacing between the compressing position and the non-compressing position of the pin in the axial direction.

7. The connecting device as claimed in claim 6, with the connecting member further including a stop piece extending perpendicularly from the first face, with the stop piece being perpendicular to the stop wall, with the draw rod further including a face opposite to the stop face, with the face of the draw rod abutting with the stop piece of the connecting member when the draw rod is in the first position.

* * * * *